US006513203B2

(12) United States Patent
Wani

(10) Patent No.: US 6,513,203 B2
(45) Date of Patent: Feb. 4, 2003

(54) TIE CLIP

(75) Inventor: Mohamad Ali Wani, Kowloon (HK)

(73) Assignee: Galactical.com Limited, Kowloon (HK)

( * ) Notice: Subject to any disclaimer, the term of this patent is extended or adjusted under 35 U.S.C. 154(b) by 0 days.

(21) Appl. No.: 09/776,845

(22) Filed: Feb. 6, 2001

(65) Prior Publication Data

US 2002/0144379 A1 Oct. 10, 2002

(51) Int. Cl.[7] ..... A41D 25/04
(52) U.S. Cl. ..... 24/66.2; 24/49.1; 24/66.8
(58) Field of Search ..... 24/49.1–66.13; 2/144, 145, 155–157; D11/202

(56) References Cited

U.S. PATENT DOCUMENTS

| | | | | | |
|---|---|---|---|---|---|
| 2,060,040 | A | * | 11/1936 | Cobb | 24/66.2 |
| 2,454,177 | A | * | 11/1948 | Howard | 24/66.11 |
| 2,465,787 | A | * | 3/1949 | Bliek | 24/66.2 |
| 2,492,254 | A | * | 12/1949 | Anderson | 24/66.11 |
| 2,501,220 | A | * | 3/1950 | Howard | 24/66.2 |
| 2,507,478 | A | * | 5/1950 | Marien | 24/66.2 |
| 2,547,125 | A | * | 4/1951 | Ingleby | 24/66.2 |
| 2,578,509 | A | | 12/1951 | Chichester | |
| 2,585,603 | A | * | 2/1952 | Vaisey et al. | 24/66.2 |
| 2,586,215 | A | * | 2/1952 | Federico | 24/66.4 |
| 2,603,016 | A | | 7/1952 | Mix | |
| 2,948,936 | A | * | 8/1960 | Winthrop | 24/66.11 |
| 2,963,759 | A | * | 12/1960 | Marien | 24/66.11 |
| 3,059,298 | A | * | 10/1962 | Stenby | 24/66.8 |
| 3,108,342 | A | * | 10/1963 | Schupbach | 24/66.13 |
| 3,319,305 | A | * | 5/1967 | Anderson | 24/66.11 |
| 3,609,823 | A | | 10/1971 | Boots | |
| 4,219,909 | A | | 9/1980 | Anderson | |
| 5,007,139 | A | * | 4/1991 | Ahern | 24/49.1 |
| 5,031,285 | A | * | 7/1991 | Wallo | 24/66.2 |
| 5,375,301 | A | | 12/1994 | Schindler | 24/66.4 |
| 5,377,390 | A | | 1/1995 | Huang | |
| 5,526,550 | A | | 6/1996 | Huang | |
| 6,163,933 | A | | 12/2000 | Smith | |

FOREIGN PATENT DOCUMENTS

| | | | | | |
|---|---|---|---|---|---|
| JP | 405059604 | A | * | 3/1993 | 2/144 |

* cited by examiner

*Primary Examiner*—J. J. Swann
*Assistant Examiner*—Ruth C. Rodriguez
(74) *Attorney, Agent, or Firm*—Burns, Doane, Swecker & Mathis, LLP

(57) ABSTRACT

Traditional tie clips usually clipping a necktie from only one side, resulting in a biased look when the tie is clipped. This may affect the overall look of the wearer. Further, the tie may be slipped away relatively easily. A tie clip (10) of the present invention provides two tie fasteners (12,14) for fastening the tie from two opposite sides. The two tie fasteners (12,14) are connected by a connector (16) that may have a recess (24) for accommodating the narrower end of a necktie. The tie fasteners (12,14) are slidably attached to the connector (16) such that the separation between the two tie fasteners (12,14) may be adjusted for use with necktie with different widths, or in a case when the wearer wishes to clip the tie clip (10) at different positions of the lower end of the tie.

17 Claims, 5 Drawing Sheets

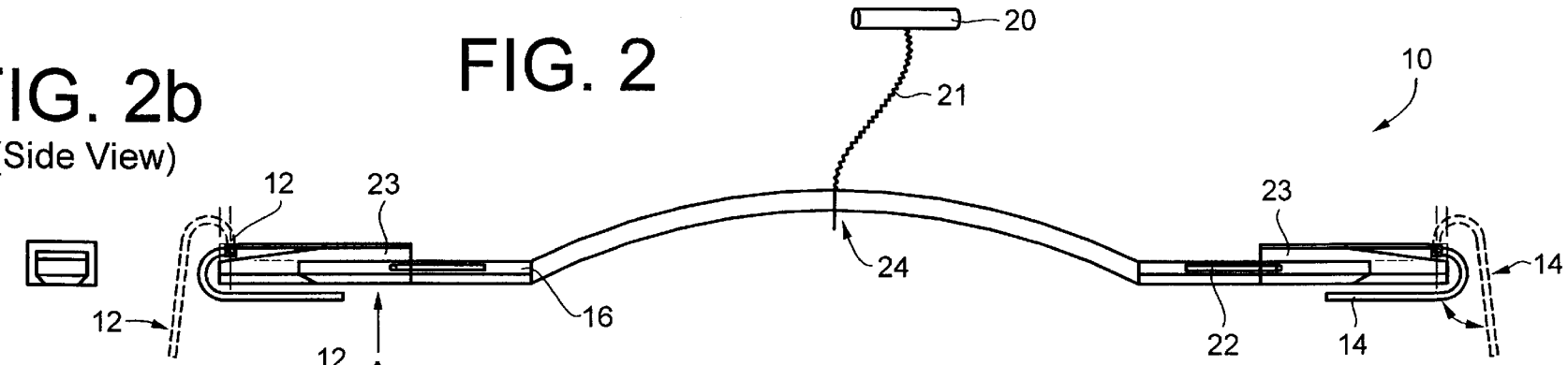
FIG. 2
FIG. 2b
(Side View)
FIG. 2a
(Front View from A)
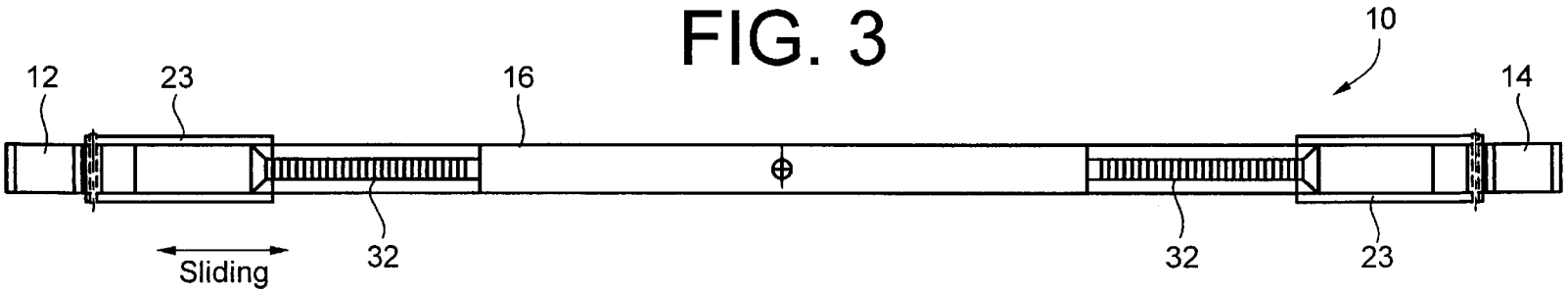
FIG. 3

TIE CLIP

TECHNICAL FIELD

The present invention relates to tie clips for fastening a necktie to a shirt.

BACKGROUND OF THE INVENTION

Neckties have been considered as an important part of business and formal dressing. In use, the top of the tie is secured within the wearer's shirt collar, and the lower ends of the tie lie adjacent to the wearer's shirt front. Usually, one of the lower ends is wider than the other and rests on top of the narrower end. A loop, usually in the form of a designer label, may be applied to the necktie during the manufacturing thereof. This label may serve as a holder for the narrower end.

It is generally desirable to maintain the necktie in a relatively centre position over the shirt. Numerous problems may arise if the ends of the tie may move away from the shirt. For instance, the necktie may get wet when the wearer washes his hand in a sink. Therefore, a number of devices generally known as tie clips have been developed to fix the tie in a proper position.

Usually a tie clip engages a necktie from one side for fixing the necktie to the placket or edge of a shirt. In general, tie clips that are capable of clamping both the wider and the narrower ends may include a bar-shaped pedestal and a clipping piece adjacent to the pedestal at one of its end, and a biasing member for biasing the clipping piece against the back of the pedestal. In operation, the necktie may be clipped between the pedestal and the clipping piece when the tie clip is opened and enters from one side of the necktie. The same clip itself may also engage the shirt of the wearer, which may not be able to give enough leverage for some normal human movements, for example, when reaching for a higher level of a file cabinet or placing luggage in an overhead compartment. In such cases, either the tie, which is clipped onto the shirt, pulls the shirt displacing it, or the tie itself is displaced, creating the need to remove the clip or re-clipping it properly.

One possible disadvantage associated with tie clip as described above may be that the necktie may escape from the tie clip relevantly easily, especially when the tie clip also engages the shirt as the traditional tie clip only engages the necktie from one side. Although this problem may be solved by introducing engagement enhancing devices like teeth into the tie clip, this may damage the tie and is therefore not desirable.

One further disadvantage of traditional tie clips that clamp a necktie from only one side may be that it may bias the tie to one side. As a result, the appearance of the wearer may be affected. Additionally, the pedestal of a traditional tie clip may have to be substantially extended in front of the necktie that may further affect the appearance of the wearer.

U.S. Pat. No. 5,375,301 describes a tie clip having a first bar on which a first clip is fixed. It further includes a second bar extending transversely and slidably connected to the first bar. A second clip is also a fixed to the second bar. In operation, the first clip is responsible for griping the designer label of the tie, while the second grip grips a placket of the shirt. However, this tie clip still clamps the necktie from only one side, and therefore, the problems as described above may still persist.

Therefore, it is an object of this invention to provide a tie clip that may solve at least part of the problems as present in the prior art. As a minimum, it is an object of this invention to provide the public with a useful choice.

SUMMARY OF THE INVENTION

Accordingly, this invention provides a tie clip for fastening a tie having two opposite sides. The tie clip includes at least one first tie fastener and at least one second tie fastener separated by a separation for fastening the opposite sides of the tie. A connector is immediate of and connecting the first and second tie fasteners, position behind a tie in use.

Preferably, the tie clip may further include at least one shirt fastener for fastening the tie clip to a shirt.

Optionally, the tie fasteners are slidably attached to the connector such that the separation between the tie fasteners (12,14) is adjustable. Preferably, the tie clip further includes a plurality of discrete stable positions on the connector for engaging the tie fasteners such that the tie fasteners are configurable between said positions to conform to different tie widths.

Preferably, the tie clip has one first tie fastener (12) and one second tie fastener (14), and the connector (16) is a bar. More preferably, wherein the connector has a recess for accommodating a narrow end of the tie.

Optionally, the tie clip has two first tie fasteners to engage a first side of a tie and one second tie fastener to engage a second of said tie, and the connector is substantially Y-shaped.

Alternatively, the tie clip has two first tie fasteners **(12*a*)** to engage a first side of a tie and two second tie fasteners to engage a second side of said tie, and the connector is substantially X-shaped.

Further, the tie clip of this invention may include decorative attachments removably attached to any one of the tie fasteners.

BRIEF DESCRIPTION OF THE DRAWINGS

Preferred embodiment of this invention will now be described with reference to the following Figures:

FIG. 2 is the top view of the tie clip of the present invention.

FIG. **2*a*** is the front view of the fastener of the tie clip.

FIG. **2*b*** is the side view of the tie fastener.

FIG. 3 is the front view of the tie clip.

Figure 4:
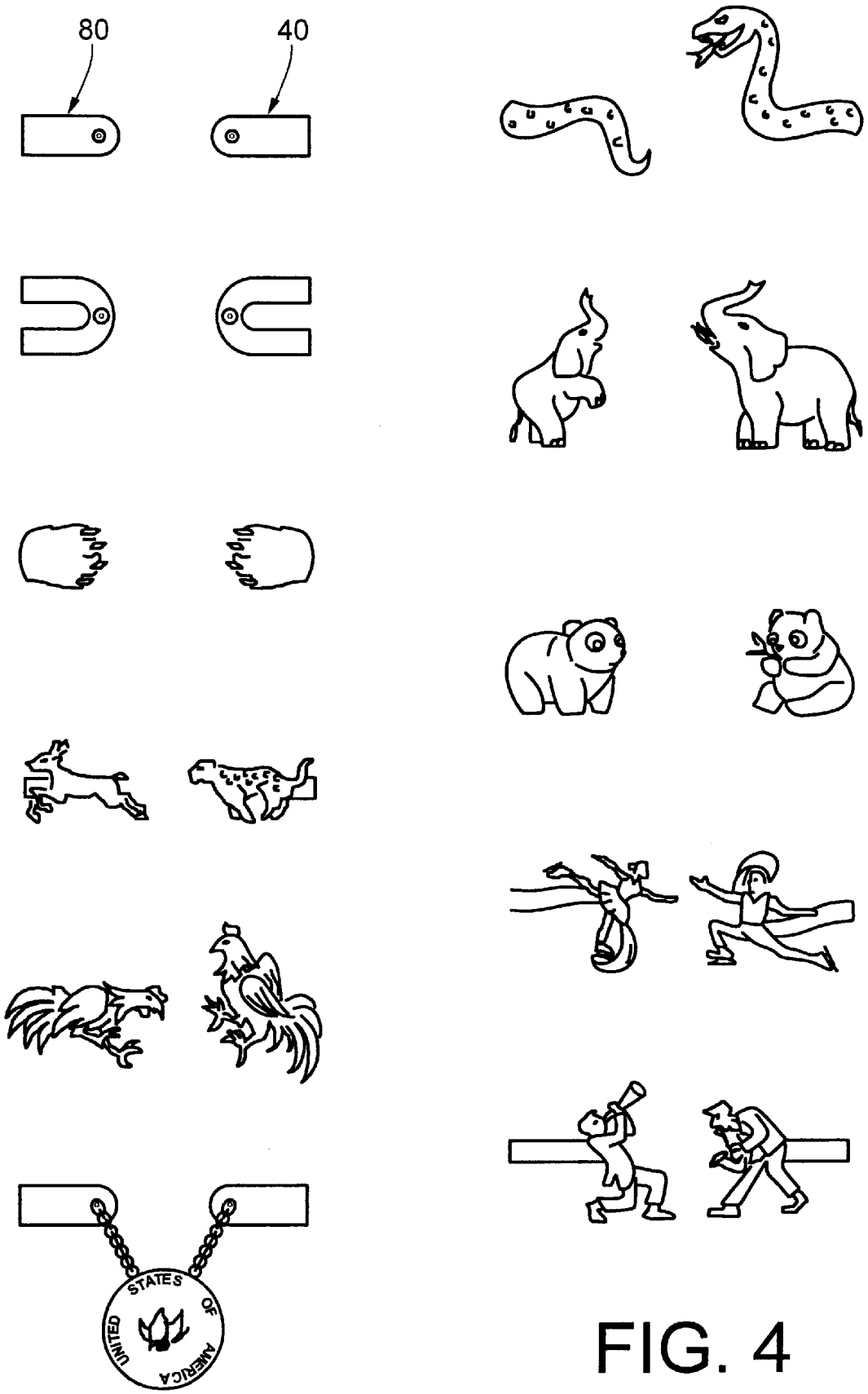

FIG. 4 shows the decorative attachments that may be attached to the tie fasteners.

Figure 5:
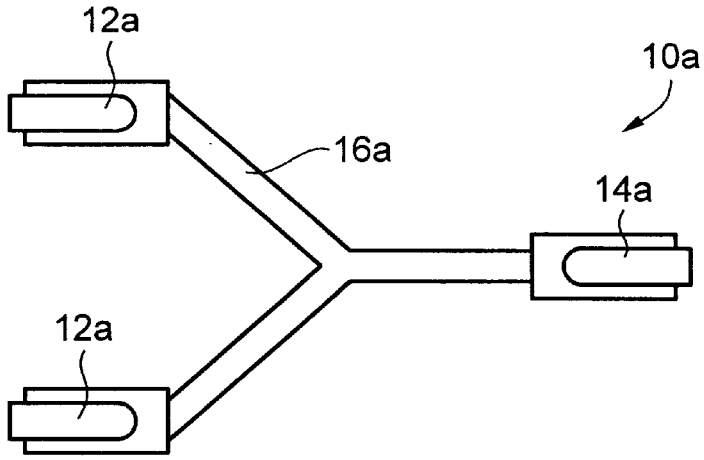

FIG. 5 shows the front view of another embodiment of the tie clip of this invention.

Figure 6:
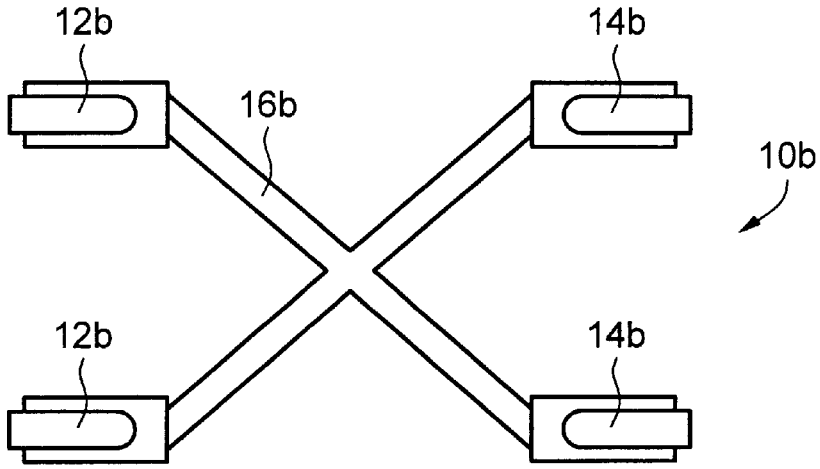
Figure 6:
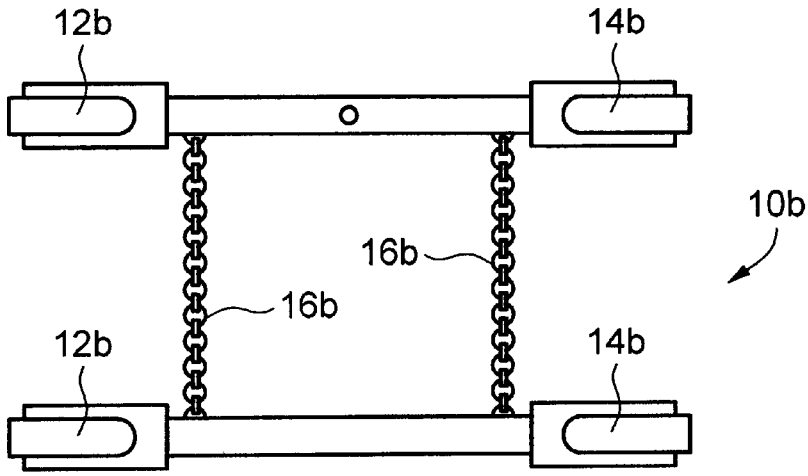

FIG. 6 shows yet another embodiment of the tie clip of this invention.

Figure 7:
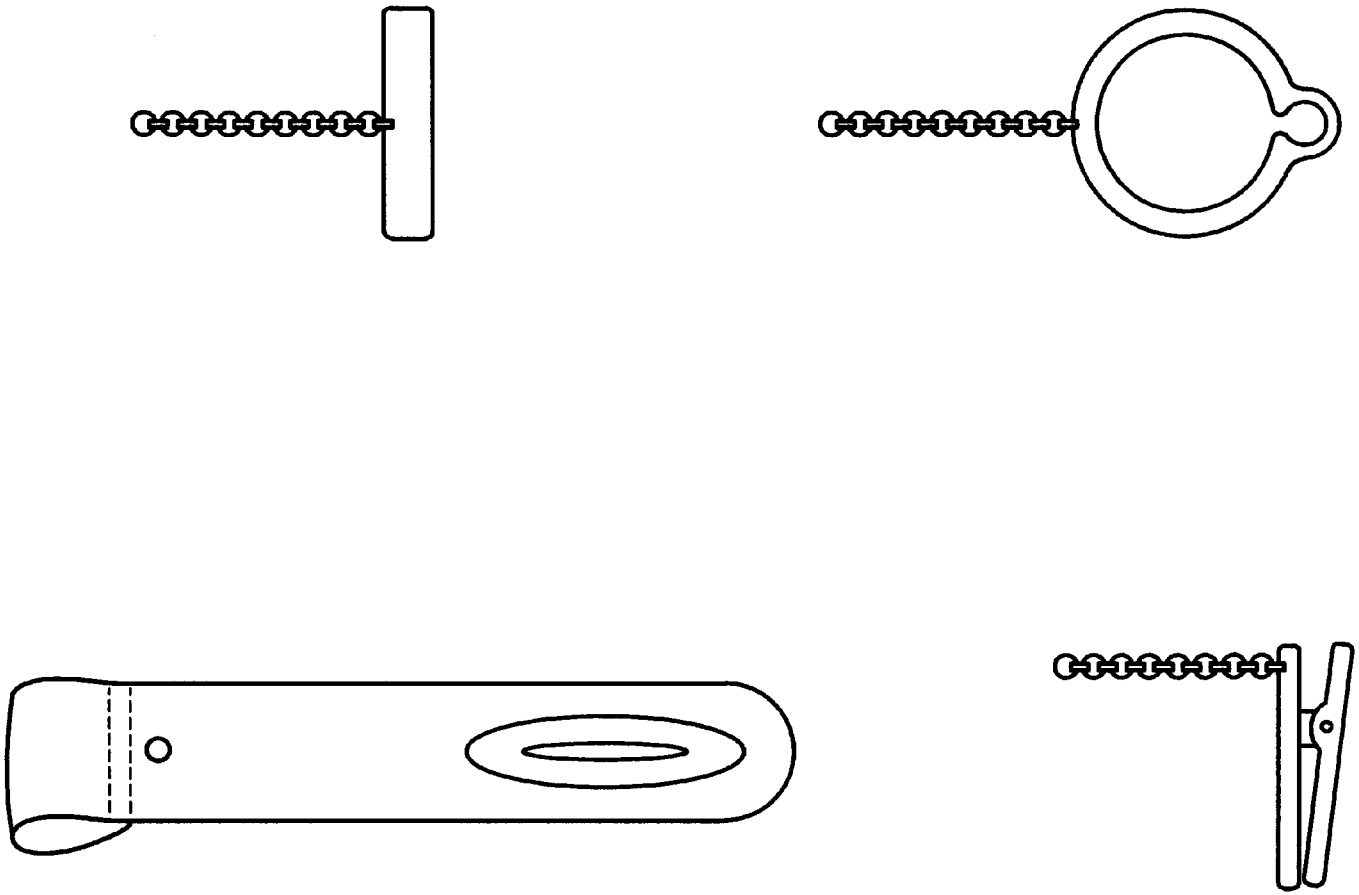

FIG. 7 shows an alternative shirt fastener.

DETAIL DESCRIPTION OF PREFERRED EMBODIMENTS

Preferred embodiments of this invention are now described with reference to the figures. List 1 is a part list so that the reference numerals in the figures may be easily referred to.

Figure 1:
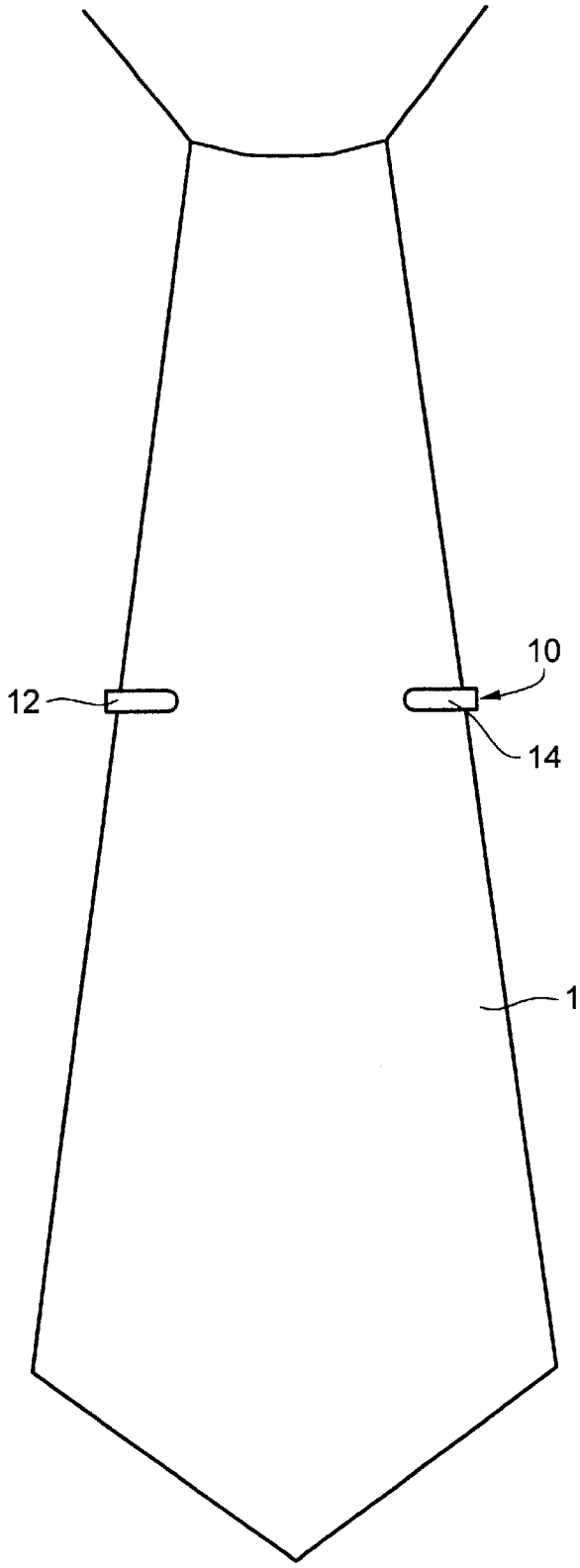
FIG. 1 is the frontal view showing a preferred embodiment of the tie clip of the present invention engaging to a necktie.

As shown in FIG. 1, the tie clip (10) of this invention engages the wider end (1) of a necktie on two opposite sides by the tie fasteners (12) and (14). The advantage for doing so may be that the tie can then be maintained in a relatively central position when compared to traditional tie clip that engages neckties from one side.

FIG. 2 shows the detail construction of a preferred embodiment of tie clip (10) of this invention. As shown in FIG. 2, the tie fasteners (12) and (14) separated by a separation are connected by a connector (16) being a metal bar. Although the tie fasteners (12) and (14) were shown to be pivotally connected to the connector (16) such that the tie fasteners (12) and (14) may effectively clamp the necktie in its closed positions, it can be envisioned that other mechanisms may also be utilized for tie fasteners (12) and (14). As an example, tie fasteners (12) and (14) may be piercing pins that are able to be clutched onto the connector. It should also be noted that the first and second tie fasteners (12) and (14) can be different from one and other. For instance, the first tie fastener (12) may be a clip while the second tie fastener (14) may be a piercing pin. However, this may be less preferred as this may increase the overall manufacturing cost.

To accommodate the narrower end of a necktie that lies below the wider end (1), the connector (16) may further possess a recess (24). The construction and the length of the recess is purely optional. For instance, instead of a concave recess (24) as shown in FIG. 2, the recess (24) may be rectangular-shaped.

It may also be desirable to provide biasing means like a spring to the tie fasteners for biasing them to their closed positions to enhance their engagements to the necktie.

The tie clip (10) of this invention may be made of any suitable precious or non-precious material including solid gold, silver, white metal casting alloy, aluminium, plastic or even wood. If the tie clip (10) is to be made of metal, it may be plated with gold, silver, palladium, or nickel. Various materials and finishes may be used for the present invention, and the scope of the present invention should not be limited by such materials.

A shirt fastener (20) may also be connected to the tie clip (10) to fasten the tie clip (10) to a shirt. The shirt fastener (20) may be connected to the tie clip (10) by means of a chain (21). Shirt fasteners other than the bar as shown in FIG. 2 may be used. Alternatives for the shirt fasteners may include clips and button holders. Further, it may not be necessary for the provision of the chain to connect the shirt fasteners to the tie clip (10). As shown in FIG. 7, the shirt fastener may be a piece of flat material which itself is capable of fastening to the shirt that has a buttonhole. Other alternative arrangements are possible but such arrangements will not affect the scope of the present invention.

The wider end (1) of necktie may have different widths. For instance, traditional English ties are wider than those of US. These changes with fashion also. In addition, different wearer may wish to fasten the tie clip at different portions of a necktie according to their own needs. Therefore, it may be desirable for the connector (16) to be extendable such that the separation between the first and second tie fasteners (12,14) can be adjusted. In the preferred embodiment as shown in FIG. 2, this may be achieved by attaching the tie fasteners onto a slidable piece (23), which in turn engages into a slot (22) on the connector (16). To further stabilized the sliding piece (23), the sliding piece (23) may further engage to a plurality of discrete stable positions being sliding steps (32) on the connector (16) such that the tie fasteners (12,14) may be stabilized.

To further enhance the appearance of tie clip (10), decorative attachments (40) may be attached to tie fasteners (12) and (14) releasably. Examples of decorative attachments (40) are shown in FIG. 4. The decorative attachments (40) may be attached to the tie fasteners (12) and (14) by any suitable means including slots on the decorative attachments such that the tie fasteners may engage into the decorative attachments, clips, soldered, screwed on, or even Velcro. These may extend across the front of the tie in any desired arrangement for fashion purposes as shown in FIG. 4.

Tie clip (10) as described above only has one first tie fastener (12) and one second tie fastener (14) connected by a connector (16) in the form of a bar. However, it is possible to have more than one first tie fasteners (12) and/or second tie fastener (14). These alternative embodiments are shown in FIGS. 5 and 6. As shown in FIG. 5, the tie clip **(10*a*) has two first tie fasteners (12*a*) and one second tie fastener (14*a*). In this case, the connector (16*a*) is substantially Y-shaped. In FIG. 6, the tie clip (10*b*) has two first tie fasteners (12*b*) and two second tie fasteners (14*b*), and they are connected by a connector (16*b*) that is substantially X-shaped. The addition of tie fasteners may enhance the clipping of the tie clip (10)** to the necktie. This may also provide more interesting combinations of the decorative attachments if desired.

It can be seen that the connector (16) can be of a number of different constructions even in the case of only one first tie fastener (12) and one second tie fastener (14). The connector (16) can be X or Y-shaped or evenly convoluted if desire.

Although additional tie fasteners may be added to the tie clip (10), this may be less desirable as this will increase the overall manufacturing cost.

Although the preferred embodiments of this invention are described in detail by the description and the drawings, it will be apparent to one skill in the art that modifications and other alternatives of the present invention are possible. It is to be expressly understood that such modifications and alternatives still lie within the scope of the present invention as set in the following claims. Finally, it should be realized that embodiments of the present invention as described in the above paragraphs shall not be interpreted to be restricted by the examples of Figures only.

List 1

| Reference Numerals | Description |
|---|---|
| 1 | wider end of necktie |
| 10, 10a, 10b | tie clip |
| 12, 12a, 12b | first tie fastener |
| 14, 14a, 14b | second tie fastener |
| 16, 16a, 16b | connector |
| 20 | shirt fastener |
| 21 | chain |
| 22 | sliding slot |
| 24 | recess of connector |
| 32 | sliding step |
| 40 | decorative attachments |

What is claimed is:

1. A tie clip for fastening a tie having two opposite sides, including:

at least one first tie fastener and at least one second tie fastener separated by a separation, for fastening the opposite sides of the tie; and a connector immediate of and connecting the first and second tie fasteners, positioned behind a tie in use and having a recess for accommodating a narrow end of the tie, wherein the connector is substantially Y-shaped and includes two first tie fasteners to engage a first side of the tie and one second tie fastener to engage a second side of the tie or the connector is substantially X-shaped and includes two tie fasteners to engage a first side of the tie and two second tie fasteners to engage a second side of the tie, wherein the tie fasteners are movably connected to the connector such that the fasteners can be moved from an open position to a closed position for fastening the tie, and the tie fasteners are positioned in front of the tie in the closed position during use.

2. The tie clip (10) of claim 1 further including at least one shirt fastener (20) for fastening the tie clip (10) to a shirt.

3. The tie clip (10) of claim 1, wherein there are one first tie fastener (12) and one second tie fastener (14), and the connector (16) is a bar.

4. The tie clip of claim 1, wherein there are two first tie fasteners to engage a first side of a tie and one second tie fastener to engage a second of said tie, and the connector is substantially X-shaped.

5. The tie clip of claim 1, wherein there are two first tie fasteners to engage a first side of a tie and two second tie fasteners to engage a second of said tie, and the connector is substantially Y-shaped.

6. The tie clip (10) of claim 1 further including decorative attachments (40) removably attached to any one of the tie fasteners.

7. A tie clip as in claim 1, wherein the tie fasteners are pivotably connected to the connector.

8. The tie clip (10) of claim 1, wherein the tie fasteners (12,14) are slidably attached to the connector (16) such that the separation between the tie fasteners (12,14) is adjustable.

9. The tie clip (10) of claim 8 further including a plurality of discrete stable positions (32) on the connector (16) for engaging the tie fasteners (12,14) such that the tie fasteners (12,14) are configurable between said positions to conform to different tie widths.

10. A tie clip for fastening a tie having two opposite sides, including:

at least one first tie fastener and at least one second tie fastener separated by a separation, for fastening the opposite sides of the tie; and a connector immediate of and connecting the first and second tie fasteners, position behind the tie in use and has a recess for accommodating a narrow end of the tie;

wherein the connector is substantially Y-shaped and includes two first tie fasteners to engage a first side of the tie and one second tie fastener to engage a second side of the tie or the connector is substantially X-shaped and includes two tie fasteners to engage a first side of the tie and two second tie fasteners to engage a second side of the tie, wherein the tie fasteners are movably connected to the connector such that the tie fasteners can be moved from an open position to a closed position for fastening the tie, and the tie fasteners position in front of the tie in use in the closed position, and wherein the tie fasteners are slidably attached to the connector such that the separation between the tie fasteners is adjustable.

11. A tie clip as in claim 10, wherein the at least one first tie fastener and the at least one second tie fasteners are pivotably connected to the connector.

12. A tie clip for fastening a tie having two opposite sides, including:

at least one first tie fastener and at least one second tie fastener separated by a separation, for fastening the opposite sides of the tie, wherein there are two first tie fasteners to engage a first side of a tie and one second tie fastener to engage a second of said tie, and the connector is substantially Y-shaped; and a connector immediate of and connecting the first and second tie fasteners, positioned behind the tie in use.

13. The tie clip of claim 12, further including decorative attachments removably attached to any one of the tie fasteners.

14. A tie clip as in claim 12, further including decorative attachments removably ably attached to at least one of the tie fasteners.

15. A tie clip for fastening a tie having two opposite sides, including:

at least one first tie fastener and at least one second tie fastener separated by a separation, for fastening the opposite sides of the tie, wherein there are two first tie fasteners to engage a first side of a tie and two second tie fasteners to engage a second of said tie, and the connector is substantially X-shaped, and a connector immediate of and connecting the first and second tie fasteners, positioned behind the tie in use.

16. The tie clip of claim 15, further including decorative attachments removably attached to any one of the tie fasteners.

17. A tie clip as in claim 15, further including decorative attachments removably attached to at least one of the tie fasteners.

* * * * *

UNITED STATES PATENT AND TRADEMARK OFFICE

CERTIFICATE OF CORRECTION

PATENT NO. : 6,513,203 B2
DATED : February 4, 2003
INVENTOR(S) : Mohamad Ali Wani It is certified that error appears in the above-identified patent and that said Letters Patent is hereby corrected as shown below:

Title page,
Item [73], Assignee, change "Galactical.com Limited, Kowloon (HK)" to
-- Galactical Trading Limited, Kowloon (HK) --.

Signed and Sealed this

Nineteenth Day of August, 2003

JAMES E. ROGAN
*Director of the United States Patent and Trademark Office*